US012378885B2

(12) United States Patent
Richter et al.

(10) Patent No.: US 12,378,885 B2
(45) Date of Patent: Aug. 5, 2025

(54) HOLLOW ROD SHEAR CONNECTOR HAVING STATIC MIXING SYSTEM AND METHOD FOR SETTING A HOLLOW ROD SHEAR CONNECTOR IN A ROCK LAYER

(71) Applicant: JMBG GMBH + CO KG, Dortmund (DE)

(72) Inventors: Archibald Richter, Dortmund (DE); Friederich Jaeger, Dortmund (DE)

(73) Assignee: JMBG GMBH + CO KG, Dortmund (DE)

( * ) Notice: Subject to any disclaimer, the term of this patent is extended or adjusted under 35 U.S.C. 154(b) by 171 days.

(21) Appl. No.: 18/034,256

(22) PCT Filed: Dec. 20, 2021

(86) PCT No.: PCT/EP2021/086732
§ 371 (c)(1),
(2) Date: Apr. 27, 2023

(87) PCT Pub. No.: WO2022/136237
PCT Pub. Date: Jun. 30, 2022

(65) Prior Publication Data

US 2023/0392500 A1 Dec. 7, 2023

(30) Foreign Application Priority Data

Dec. 23, 2020 (DE) ..... 10 2020 134 867.3

(51) Int. Cl.
*E21D 20/02* (2006.01)

(52) U.S. Cl.
CPC ..... *E21D 20/028* (2013.01)

(58) Field of Classification Search
CPC .... E21D 21/00; E21D 21/0026; E21D 20/028
See application file for complete search history.

(56) References Cited

U.S. PATENT DOCUMENTS 3,286,992 A * 11/1966 Armeniades ..... B01F 25/43141 261/DIG. 26
4,353,463 A 10/1982 Seemann
(Continued)

FOREIGN PATENT DOCUMENTS

DE 69317784 T2 8/1998
DE 10301968 A1 7/2004
(Continued)

OTHER PUBLICATIONS

International Search Report (English and German) and Written Opinion of the ISA (German) issued in PCT/EP2021/086732, mailed Apr. 14, 2022; ISA/EP.

*Primary Examiner* — Janine M Kreck
(74) *Attorney, Agent, or Firm* — Harness, Dickey & Pierce, P.L.C.

(57) ABSTRACT

The disclosure relates to a hollow rod shear connector for stabilizing rock layers in mining, tunnel construction, civil engineering and rock construction, at least having a connector base with one or more outlet channels and a hollow rod which can be fastened to the connector base and comprises a static mixing apparatus adjoining the connector base, a cartridge, divided by a partition into two compartments, for receiving chemical fastening means, and a two-part plunger corresponding to the compartment division, wherein the static mixing apparatus consists of a plurality of mixing elements one behind the other, wherein the flow direction of the chemical fastening means is changed by greater than or equal to 150° and less than or equal to 210° at least twice along the static mixing apparatus. The present disclosure also relates to a method for setting a hollow rod shear connector in a rock layer.

10 Claims, 3 Drawing Sheets

(56) References Cited

U.S. PATENT DOCUMENTS

Figure 1:
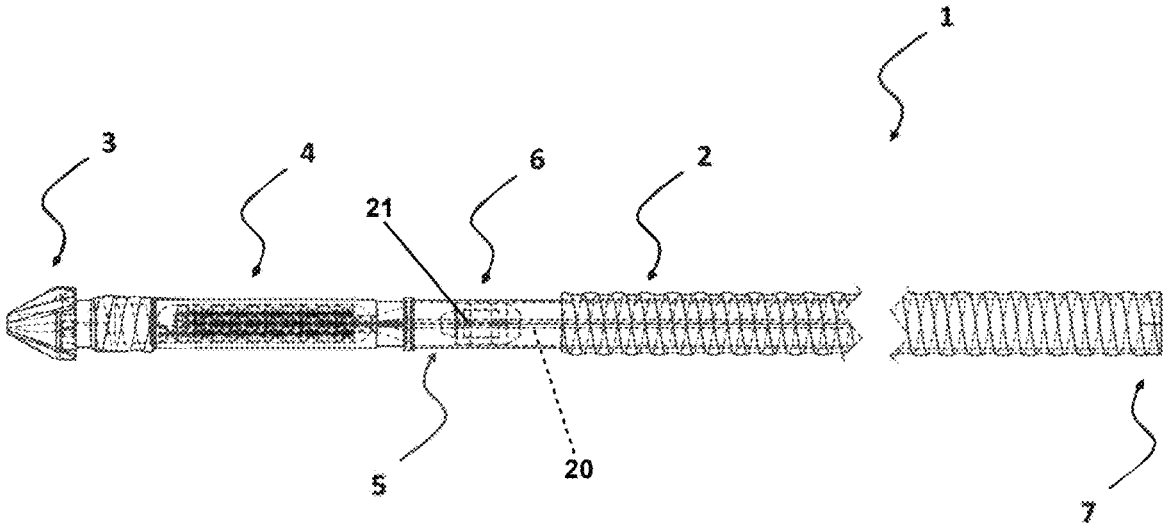

| | | | | |
|---|---|---|---|---|
| 4,601,614 | A * | 7/1986 | Lane | E21D 21/008 405/269 |
| 4,652,175 | A | 3/1987 | Mauthe | |
| 4,801,008 | A * | 1/1989 | Rich | B65D 81/3255 222/137 |
| 5,487,606 | A * | 1/1996 | Keller | B01F 25/43141 222/137 |
| 2001/0028833 | A1 | 10/2001 | Sager et al. | |
| 2005/0260041 | A1 | 11/2005 | Ludwig et al. | |

FOREIGN PATENT DOCUMENTS

| | | | |
|---|---|---|---|
| DE | 102006046762 | A1 | 4/2008 |
| DE | 102009056089 | A1 | 6/2011 |
| DE | 102010014612 | A1 | 10/2011 |
| DE | 102011102994 | A1 | 6/2012 |
| EP | 0319639 | A1 | 6/1989 |
| EP | 2251526 | A2 | 11/2010 |
| EP | 2532832 | A2 | 12/2012 |
| WO | 2010072792 | A1 | 7/2010 |

* cited by examiner

HOLLOW ROD SHEAR CONNECTOR HAVING STATIC MIXING SYSTEM AND METHOD FOR SETTING A HOLLOW ROD SHEAR CONNECTOR IN A ROCK LAYER

CROSS-REFERENCE TO RELATED APPLICATIONS

This application is a U.S. National Phase Application under 35 U.S.C. 371 of International Application No. PCT/EP2021/086732, filed on Dec. 20, 2021, which claims the benefit of German Patent Application No. 10 2020 134 867.3, filed on Dec. 23, 2020. The entire disclosure of the above German patent application is incorporated herein by reference.

FIELD

The disclosure relates to a hollow rod composite anchor for stabilizing rock strata in mining, tunnel construction, civil engineering and rock construction, at least comprising an anchor base with one or more outlet channels and a hollow rod which can be attached to the anchor base and comprises a static mixing device adjoining the anchor base, a cartridge divided by a partition into two compartments for receiving chemical fastening agents, and a two-part squeezing plunger corresponding to the compartment division, wherein the static mixing device consists of a plurality of mixing elements arranged one behind the other, wherein the flow direction of the chemical fastening agent is changed at least twice along the static mixing device by greater than or equal to 150° and less than or equal to 210°. Furthermore, the present disclosure relates to a method for setting a hollow rod composite anchor in a rock stratum.

BACKGROUND

This section provides background information related to the present disclosure which is not necessarily prior art.

The permanent securing of unstable rock strata is still a challenging object today from technical and economic perspectives. Due to the increased securing requirements, for example in mining and tunnel construction, so far "reliable" approaches have been pursued as gold standard, which, regardless of the concrete rock situation at hand, are based on significantly oversized but safe "one fits all" solutions. In the field of stabilization of outer rock strata by mechanical anchors this means specifically that anchors are used which usually exceed the holding forces required for stabilization many times. In the past, this approach was economically justifiable, but it does not take into account the fact that the cost distribution for carrying out work has shifted in an increasing share in the direction of personnel costs. For example, the setting of non-adapted anchors can lead not only to increased material costs but also to increased time and thus personnel costs. Moreover, safe anchors do not always lead to technically optimal solutions, since adaptively set anchors provide significantly higher reproducibility and, in particular, increase work safety for the workers performing the work.

The patent literature also includes a wide variety of approaches with respect to the use and design of composite anchors.

For example, DE 1020 060 467 62 A1 discloses a hollow rod composite anchor designed as a cartridge anchor, usable as a two-step anchor for use in mining, tunnel construction, civil engineering and rock construction, comprising an adhesive at least partially embedded in a hollow rod bore of a hollow rod, in particular a prefabricated pressure-sensitive adhesive, at least one bursting valve provided at the anchor base side, and at least one piston positioned at the anchor base side, wherein the outer surface of the hollow rod composite anchor is coated with an adhesive, optionally with an admixed filler.

As a further technical option, DE 1020 090 560 89 A1 discloses a single-phase self-drilling and two-phase cartridge spiral mixer anchor designed to be resistant to rotary impact, as a hollow rod anchor with/without drill bit, chip chamber, step mill and rotary slide, but with an externally applied or rolled-on mixer spiral, as an active motion mixer for thin-bed mixing with/without a fixed cartridge tube with the cooling channels and adhesive ribs for cooling the drill bit and for accommodating the adhesive cartridge with a tensioning adhesive, designed for mixing the squeezed-out adhesive cartridge in the anchor ring space and for curing with a chemically controlled increase in volume, for additional anchor tensioning for use in mining and tunnel construction, civil engineering and rock construction, configured in such a way that with the externally applied mixer spiral, as an active motion mixer, a thin-bed mixing is carried out in the total anchor length.

A further embodiment of a device for fastening a rock anchor in a hole in the rock is disclosed in DE 69 317 784 T2, wherein said device comprises a fastening element, in particular an expansion anchor, provided on a threaded part at the inner end of a rock anchor, wherein the outer end of the rock anchor is provided with a washer-like pressure element configured to press against the rock, comprising a nut on a threaded part at the outer end of the rock anchor for pressing against a support element comprising an opening for the supply of grouting mortar for filling the cavity between the rock anchor and the rock, for improving the anchorage and for forming a corrosion protection, wherein the rock anchor is provided with a tube extending over at least the major part of the free length of the rock anchor and being adapted to supply grouting mortar to the inner end of the rock hole, wherein the support element has the shape of an at least partially spherical shell, with an inner space for supplying grouting mortar through a hole formed in the side wall of said support element.

Such solutions, known from the prior art, may offer further potential for improvement, in particular with regard to the design of the device adapted to the rock situation at hand and with regard to the simplicity, safety and speed of the setting process.

SUMMARY

This section provides a general summary of the disclosure, and is not a comprehensive disclosure of its full scope or all of its features.

It is thus the object of the present disclosure to at least partially overcome the disadvantages known from the prior art. In particular, it is the object of the present disclosure to provide an improved composite anchor and an improved method for setting a composite anchor in a rock stratum, wherein in particular the setting process is simplified and made faster.

The object is achieved by the features of the independent claims, relating to the hollow rod composite anchor according to the disclosure and the method according to the disclosure. Preferred embodiments of the disclosure are provided in the subclaims, in the description or in the figures, wherein further features described or shown in the subclaims or in the description or in the figures may individually or in any combination may constitute an object of the disclosure, as long as the context does not clearly indicate the contrary.

According to the disclosure, the object is achieved by a hollow rod composite anchor for stabilizing rock strata in mining, tunnel construction, civil engineering and rock construction, at least comprising an anchor base with one or more outlet channels and a hollow rod which can be attached to the anchor base and comprises a static mixing device adjoining the anchor base, a cartridge which is divided into two compartments by a partition wall for receiving chemical fastening agents and a two-part squeezing plunger corresponding to the compartment division, characterized in that the static mixing device consists of a plurality of mixing elements arranged one behind the other, wherein the flow direction of the chemical fastening agent along the static mixing device is changed at least twice by greater than or equal to 150° and less than or equal to 210°.

Surprisingly, it has been found that by means of the hollow rod composite anchor design according to the disclosure, rock structures can be stabilized at the surface very reproducibly and quickly. In particular, the proposed design of the mixing unit, together with the provision of a two-component adhesive system, can contribute to ensure that the mixing process can be carried out very efficiently within very short time periods. In sum, this results in very short process times and a homogeneous bonding of the anchor in the rock. The compact design allows the use of a relatively large volume of adhesive, which can also be used in rock strata that are difficult to stabilize, for example in porous formations. Contrary to the assumptions of the prior art, this combination does not result in any appreciable increase in the backpressure during squeezing, so that very fast squeezing and subsequent setting processes result even under relatively moderate squeezing pressures. All in all, reproducible fastening strengths of the anchors in the rock are achieved with reduced effort and time requirements, while in particular also the work safety is increased because the risk of unintentional leakage with escape of the blowing agent is reduced. Moreover, the anchor design is so flexible that a wide range of different fastening compositions can be used. In addition to the composition, the length and volume ratio of the individual anchor components relative to one another enables to precisely adjust the fastening strengths to be achieved, so that the fastening strengths can be reproducibly and precisely adjusted as a function of the required rock situation.

The hollow rod composite anchor according to the disclosure is suitable for stabilizing rock strata in mining, tunnel construction, civil engineering and rock construction. Rock strata can be strengthened at the surface by inserting anchors to prevent rock fragments or slabs from slipping off unintentionally. The composite anchors are inserted with the anchor base into the anchor boreholes, which are produced by wet or dry drilling methods depending on the rock hardness. The composite anchor comprises a plurality of subassemblies, wherein in addition to the anchor base, the other parts are usually arranged within a cylindrical rod. The hollow rod may be made of metal, such as steel. The hollow rod composite anchor is first inserted into the borehole at the anchor base side and pushed completely into the borehole by means of the hollow rod attached thereto. It is possible that the hollow rod composite anchor consists of only one hollow rod with anchor base or of a plurality of hollow rods and one anchor base. Here, the further hollow rods can serve as an extension of the first hollow rod composite anchor by means of a mechanical connection option.

The hollow rod composite anchor comprises at least one anchor base with one or more outlet channels. The anchor base is located at the deepest point of the borehole after insertion of the hollow rod composite anchor, and fastening agents can be fed out of the anchor base into the surrounding rock via the outlet channels. By means of the outflowing fastening agent an adhesive is applied to the whole or at least a large part of the anchor at the outside, so that after setting a firm bond is achieved between the hollow rod composite anchor and the surrounding rock stratum. The outlet channels can be arranged symmetrically or asymmetrically at or in the anchor base and preferably the anchor base can comprise more than 2, preferably more than 3 and further preferably more than 4 outlet channels.

The hollow rod can be attached to the anchor base. The hollow rod with the other structural components of the hollow rod composite anchor can either be permanently connected to the anchor base or designed to be connectable thereto. For example, the hollow rod can be connected to the anchor base via a screw, clamp, weld or adhesive connection, or can be connected to the anchor base shortly before insertion. In this way, variable anchor bases, depending on the rock situation, or different hollow rods for example with varying hollow rod volume can be used for fastening. The material of the hollow rod can preferably be made of metal, further preferably of steel. Possible dimensions of the hollow rod are in a range of about 50 cm to 3 m in length and 2.5 cm to 50 cm in diameter.

Adjacent to the anchor base a static mixing device is disposed. Starting from the deepest point of the borehole, at first the anchor base extends and, attachable thereto, the hollow rod, wherein the static mixing device is located inside the hollow rod adjacent to the anchor base. A static mixing device has no mechanically driven mixing elements. The mixing action of the static mixer is essentially based on the forced guidance of the components to be mixed through the guiding devices of the static mixer. The components to be mixed are thus first guided through the static mixer, mixed therein and leave the mixing device towards the anchor base. The mixed adhesive is passed through the outlet channels of the anchor base into the gap between the hollow rod composite anchor and the rock, where it then cures completely. Preferably, the mixing device may have an extension in the longitudinal direction of the hollow rod composite anchor of greater than or equal to 5 cm and less than or equal to 50 cm. Preferably, the ratio of mixer length to total hollow rod composite anchor length, expressed as the length of the static mixer unit divided by the length of the hollow rod composite anchor, can be greater than or equal to 0.01 and less than or equal to 0.5. Within this range, good mixing results can be achieved with still sufficient adhesive volumes.

Furthermore, the hollow rod composite anchor comprises a cartridge divided into two compartments by a partition wall for receiving chemical fastening agents. The static mixer is filled with fastening agents via a cartridge, wherein the fastening agent can preferably be a two-component adhesive consisting of hardener and binder. The two adhesive components can preferably be filled in the different compartments of the cartridge and be present separately from one another via the partition wall. The two compartments of the cartridge may have identical or different volumes. The adhesive component(s) in the cartridge is/are partially liquefied by pressurization and driven toward the mixer. There, the components are intimately mixed and react. The mixed adhesive exits the anchor base via the outlet channels and cures between the anchor exterior and the borehole wall partially or completely over the borehole length up to the anchor head.

Furthermore, the hollow rod composite anchor comprises a two-part squeezing plunger corresponding to the compartment division. In the case of a two-component adhesive system, the two different adhesive components are each present in separate compartments. In order to react the two components with each other, they are each pressed through the static mixing unit towards the anchor base by a squeezing plunger. Here, the squeezing plunger is designed in such a way that each of the individual compartments is squeezed out by a separate part of the squeezing plunger. Thus, the shape of the squeezing plunger is adapted to the geometry of the corresponding compartment. According to the division of the individual compartments, the individual parts of the squeezing plunger can have different surface areas. However, it is also possible that the two parts of the squeezing plunger are designed symmetrical, in particular in cases where the two components of the adhesive system occupy approximately equal volumes within the hollow rod. The two parts of the squeezing plunger can squeeze out the respective compartments independently of each other by applying pressure. However, it is also possible that both parts are designed to be connectable to each other, so that they move together and simultaneously in the direction of the anchor base when pressure is applied. Preferably, the squeezing plunger can be made of plastic or metal.

The static mixing device is formed of a plurality of mixing elements arranged one behind the other, wherein the flow direction of the chemical fastening agent along the static mixing device is changed at least twice by greater than or equal to 150° and less than or equal to 210°. The static mixing device is formed from individual mixing elements, wherein the geometry of the individual mixing elements and the arrangement of the mixing elements one behind the other determine the overall mixing action of the static mixing device. The mixing effect results from the overflow of the individual element and additionally via the guidance along the individual elements. In particular, it has been found to be very efficient that, by means of the arrangement of the individual mixing elements relative to each other, the total flow of the fastening agent to be mixed through the mixing device is reversed at least twice. With regard to the alignment of the hollow rod composite anchor, this means that the flow of the fastening agent is guided, for example, once in the direction of the anchor base, then in the direction of the borehole mouth and then again in the direction of the anchor base. This type of guidance is unusual in the field of hollow rod composite anchors, since it is usually assumed that the additional forces resulting from the reversal of the flow direction lead to a significant increase in the squeezing pressure and the squeezing time, so that safe handling of the hollow rod composite anchor cannot be reproducibly guaranteed. Surprisingly, however, this is not the case and even very viscous and large quantities of fastening agent can be passed by the mixing device according to the disclosure. Preferably, the change of the flow direction of the already mixed fastening agent can be about 180° twice. The change in the flow direction does not have to occur immediately. Thus, it is also according to the disclosure that the flow direction results over a certain distance in the mixing device. For example, the change in flow direction may occur within a distance which is less than or equal to 10% of the total mean path of the fastening agent through the static mixing element.

In a preferred embodiment of the hollow rod composite anchor, the cartridge may have an outlet opening at the anchor base side to at least one of the outlet channels of the anchor base, wherein the outlet opening of the cartridge is arranged eccentrically to the axis of symmetry of the cartridge. In order to obtain a static mixing element that is as compact as possible and to reduce the necessary squeezing pressure, it has proven to be particularly advantageous that the outlet opening of the cartridge is not arranged symmetrically at the cartridge. For example, for cylindrically designed cartridges it can be favorable that the outlet opening is not arranged in the center of the cylinder, but rather offset in the direction of the circle circumference. This arrangement of the outlet opening is rather unusual, since one normally strives for a symmetrical flow of the fastening agent in order to achieve the most even distribution of the fastening agent over the entire hollow rod composite anchor. Surprisingly, it has been found that despite the asymmetrical guidance of the mixed fastening agent, a very uniform bonding of the anchor to the surrounding rock is obtained.

In another preferred embodiment of the hollow rod composite anchor, the mixing elements of the static mixing device may be present in at least three different mixing element rows, wherein the axes of symmetry of the individual mixing element rows are offset from each other. For an improved mixing performance with only a low increase in counterpressure during squeezing, it has proved particularly advantageous for the individual mixing elements to be arranged in rows, wherein the individual rows lie side by side rather than behind one another. The offset of the symmetry axes of the individual mixing element rows results in an improved guidance of the adhesive in the static mixer. Preferably, the axes of symmetry of the individual mixing element rows can form a triangle in the direction of the axis of symmetry of the anchor. This may contribute to the formation of a particularly compact mixing device design while maintaining the necessary mixing performance.

Within a further preferred aspect of the hollow rod composite anchor, the different mixing element rows may be disposed offset relative to the anchor base along the longitudinal axis of the hollow rod composite anchor. In order to minimize the additional contribution of the static mixer element to the flow resistance, it has been found to be particularly advantageous that the axes of symmetry of the rows of mixing elements are not arranged on the axis of symmetry of the hollow rod composite anchor. For example, it can be favorable that the axis of symmetry of the hollow rod composite anchor is in the centroid of a triangle, wherein the axes of symmetry of the individual rows of mixing elements are arranged at the apexes of the triangle. This may further reduce the necessary dimensions of the static mixer and may be particularly favorable in cases where the outlet of the mixed product from the static mixer is likewise not disposed on the axis of symmetry of the hollow rod composite anchor.

According to a preferred embodiment of the hollow rod composite anchor, the static mixing device can consist of individual mixing elements, wherein the mixing elements have at least two different geometries. In order to optimize the mixing result while reducing the spatial extension of the static mixer in the direction of the axis of symmetry of the hollow rod composite anchor, it has proven particularly advantageous that not only one type of mixing element is mounted in the individual rows of mixing elements. In particular, it may prove favorable to have two different elements in one mixing element row. This can simplify the flow guidance of the fastening agent and reduce the flow resistances occurring in the static mixer.

In the context of a preferred characteristic of the hollow rod composite anchor, the squeezing plunger may comprise at least a three-part symmetrical design with spaced upper and lower guide lips and central sealing lips, wherein the smallest spacing of the outer guide lips to the inner sealing lips with respect to the longest extension of the inner sealing lips is greater than or equal to 0.25 and less than or equal to 0.75. The design of the squeezing plunger may be of particular importance in cases in which the highest possible pressure has to be built up to secure the anchor in the rock. This situation may arise, for example, when very long anchors have to be anchored in the rock. A further difficulty arises for cases in which very viscous fastening agents are used, which also have a low dilatancy. In these cases, it must be ensured that the squeezing plunger can exert a uniform force onto the fastening means. In addition, the design of the squeezing plunger must ensure that the squeezing medium, for example water or compressed air, is not pressed past the squeezing plunger into the fastening agent. In these cases, a reduced adhesive force of the fastening agent and only an insufficient securing of the anchor in the rock can result. The above-mentioned three-part design with a defined distance between the outer guide lips and the central sealing lips has proved to be particularly suitable for both low and high viscosity systems. Even under high pressures, the design can contribute to a uniform feed rate of the squeezing plunger into the adhesive cartridge. A uniform feed rate can also be achieved in particular for cases where the two compartments of the adhesive have different volumes. Without being bound by theory, these advantages are achieved by the fact that the inner sealing area of the squeezing plunger provides a sufficient sealing effect, wherein the force applied to the squeezing plunger is provided via the guide lips of the squeezing plunger. Slight changes in the squeezing pressure can thus be compensated for via the guide lips of the squeezing plunger. According to a further preferred embodiment, the central sealing part of the squeezing plunger can comprise more than two, and further preferably more than three, individual sealing lips or sealing bulges. As a material, in particular for the central part comprising the sealing lips, plastics such as PEEK, PE, PP, POM or rubber have proven to be particularly suitable. It may be further advantageous that the squeezing plunger is made of only one material.

According to a further preferred embodiment of the hollow rod composite anchor, the two parts of the two-part squeezing plunger can be rigidly connected to one another at least via a partition wall cutting device. For a uniform pressure transmission and for a uniform mixing result, it has proven to be particularly advantageous that the two parts of the squeezing plunger are mechanically connected to each other. This embodiment results in a uniform feed rate and thus a uniform squeezing of the two-component adhesive from the compartments. In order to realize a particularly fast squeezing speed in these cases, it is advantageous that the destruction of the compartment wall takes place via a cutting device. This cutting device can, for example, be formed by a knife or a sharp edge. In this embodiment, particularly fast squeeze-out times under uniform compressive stress can be realized.

Within a preferred aspect of the hollow rod composite anchor, the two parts of the two-part squeezing plunger may be configured mirror-symmetrical and the partition wall cutting device may be arranged off-center from the common axis of symmetry of the two squeezing plungers. In particular in cases where the two compartments of the cartridge have different volumes, it may prove advantageous that the cutting device is not arranged on the axis of symmetry of the squeezing plunger. Thus, in cases where the squeezing plunger is rotationally symmetrical, the cutting device can be arranged on the axis of rotation or spaced apart therefrom. In the case described above, the cutting device is advantageously arranged spaced apart from the axis of rotation, so that not only the center of the partition wall between the compartments, but also a part of the surrounding partition wall at the compartment edges is also cut open. This can contribute to a faster and more uniform squeezing process of the adhesive from the individual compartments.

According to a preferred embodiment of the hollow rod composite anchor, a burst valve may be arranged in the at least one outlet channel of the anchor base. In order to ensure a sufficient counterpressure and to protect the anchor base and the static mixer against material entering unintentionally, it has proven advantageous for the outlet channels to have burst valves that open as a function of the pressure only after significant pressurization of the hollow rod composite anchor in the course of a deliberate squeezing process. This can prevent an unintentional destruction of the compartments via the squeezing plunger due to a mechanical load occurring for a short time and contribute to a uniform and controlled squeezing process.

In a preferred embodiment of the hollow rod composite anchor, the plunger may have one or more venting channels along the axis of symmetry of the squeezing plunger. In order to simplify the squeezing process, it may be advantageous that the squeezing plunger comprises openings that allow air to pass through from the direction of the anchor base toward the borehole mouth. This can lead to a more uniform squeezing of the adhesive and, due to the lower counterpressure, to an increase in work safety.

According to a further preferred embodiment of the hollow rod composite anchor, a plastic sheathing with spacers disposed at the inside can be arranged at the outside of the hollow rod composite anchor. Due to the higher squeeze-out speeds achievable as a result of the improved mixing process, it can be useful to guide the adhesive flow emerging from the anchor base, at least partially, via a plastic sheathing, which is spaced apart from the surface of the hollow rod composite anchor by spacers. In addition to the spacers to the anchor rod, the plastic sheathing can also have further means on its surface for guiding the emerging adhesive flow. This can be achieved, for example, by means of shaped protuberances which impart a further, specific directional impulse to the flow. This embodiment may be particularly suitable for cases in which the outlet channels of the anchor base are not symmetrically distributed over the anchor base surface. In this way, uneven distributions of the emerging flow can be made uniform over the hollow rod composite anchor surface.

According to a preferred embodiment of the hollow rod composite anchor, the hollow rod can comprise at a point furthest from the anchor base fastening means for mounting a further hollow rod. For a flexible design of the hollow rod composite anchor, it has proved advantageous that the anchor end lying in the direction of the borehole mouth is prepared to be connected to a further hollow rod. In this way, even in confined spaces, for example in narrow tunnels, deep boreholes can be easily equipped with one or more hollow rod composite anchors. For example, only the first anchor can have a static mixing element and the other anchors can exclusively provide further adhesive compartments with squeezing plungers. The adhesive mixtures of the different hollow rod composite anchor compartments can differ in structure. For example, the further compartments may have adhesives with volume increasing agents, such as foaming systems, which are capable of securely caulk larger volumes. This embodiment with extendable hollow rod composite anchors can also have exit openings at still further anchor locations, so that not the entire amount of adhesive does have to exit at the outlet channels of the anchor base. This can improve handling and flexibility even at very large borehole depths.

In a preferred characteristic of the hollow rod composite anchor, the hollow rod may have means for uniquely identifying the hollow rod. In order to improve quality management, it may prove advantageous that the individual hollow rod composite anchor is configured for unique identification. This can be done, for example, by means of a marker applied to the hollow rod surface, the anchor base or the hollow rod end. For example, color, bar or QR codes or RFID markers can be used for this purpose. The unique allocation allows manufacturing conditions such as time, place, length of the anchor and personnel to be clearly allocated and archived for further analysis.

Further according to the disclosure a method for setting a hollow rod composite anchor in a rock stratum is provided, wherein the method comprises at least the steps of:

a) drilling a hole in a rock stratum to be stabilized;
b) setting a hollow rod composite anchor according to the disclosure; and
c) squeezing the chemical fastening agent from the two compartments through the static mixer and the anchor base by pressurization. Surprisingly, it has been shown that by means of the process according to the disclosure, rock strata that are difficult to stabilize can be secured in a very reproducible manner. Work safety is increased, and the use of the hollow rod composite anchors according to the disclosure, it is possible to react adaptably to the rock conditions at hand. Moreover, in contrast to the prior art anchors, the setting process can be carried out very quickly. For example, the squeezing process can take place within 15 seconds, preferably within 10 seconds and further below 5 seconds. Within these squeezing times, very uniform stabilizations of the anchor in the rock can be achieved, which helps to reduce the costs for the setting process. Furthermore, the squeezing can be done by compressed air or water, wherein it is possible to work within "usual" pressure ranges. Thus, advantageously, no special equipment is required for setting. For the further advantages of the method according to the disclosure, explicit reference is made to the advantages of the hollow rod composite anchor according to the disclosure.

In a preferred embodiment of the method, in method step c) the pressure load can be recorded over time for each squeezing process and stored digitally. For the quality control of the setting process and for detecting unpredictable rock anomalies, recording and storing the time-dependent pressure profiles of the squeezing process has proven to be particularly reliable. Unexpected positive or negative changes in the applied squeezing pressure can indicate deviations in the assumed properties of the rock formation, which can have a significant influence on the desired success of the stabilization measures. These can be detected via the pressure profile and give rise to further preventive measures.

DRAWINGS

The drawings described herein are for illustrative purposes only of selected embodiments and not all possible implementations, and are not intended to limit the scope of the present disclosure.

Further advantages and advantageous embodiments of the subject matter according to the disclosure are illustrated by the examples and drawings and explained in the following description. It should be noted that the drawings are descriptive only and are not intended to limit the disclosure.

Figure 2:
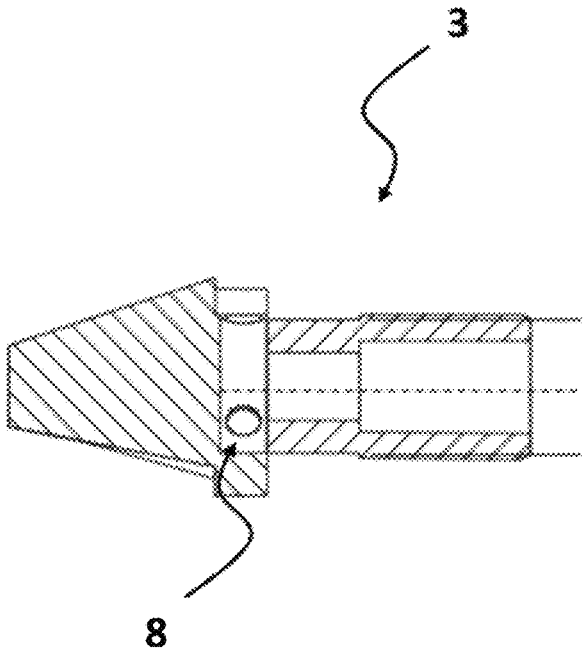
Figure 3:
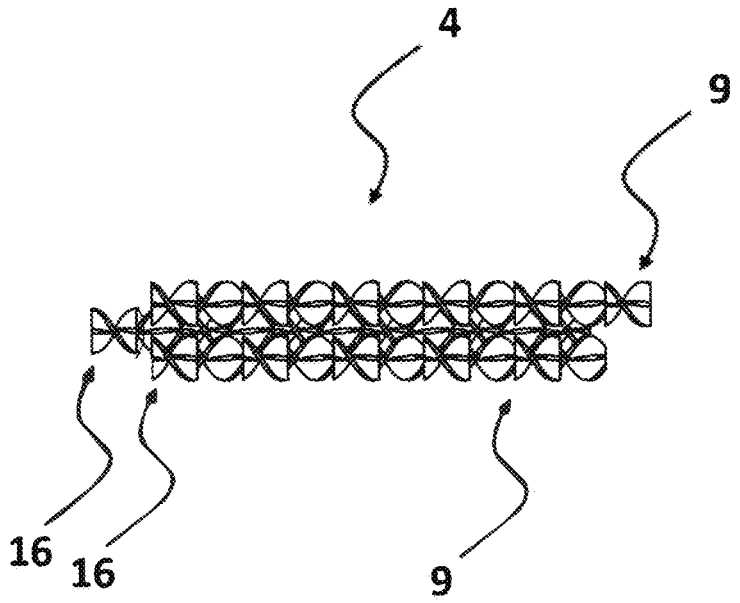
Figure 4:
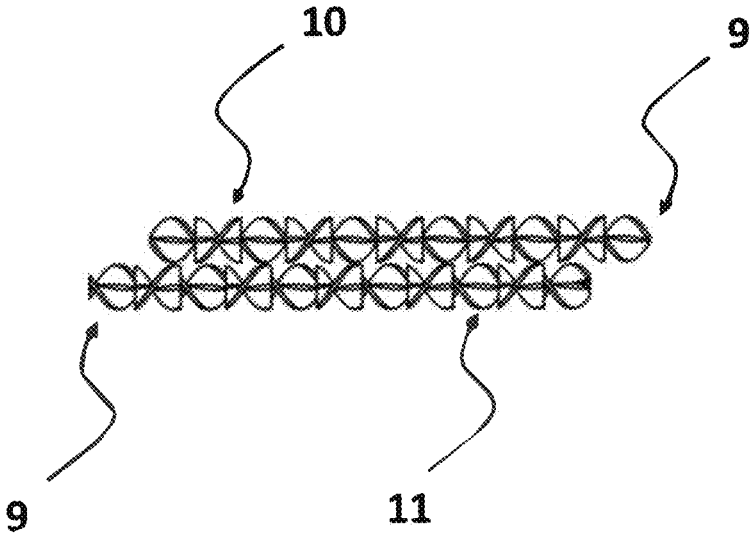
Figure 5:
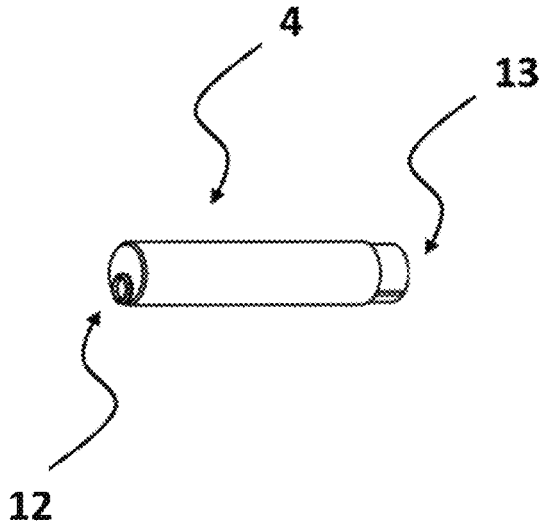
Figure 6:
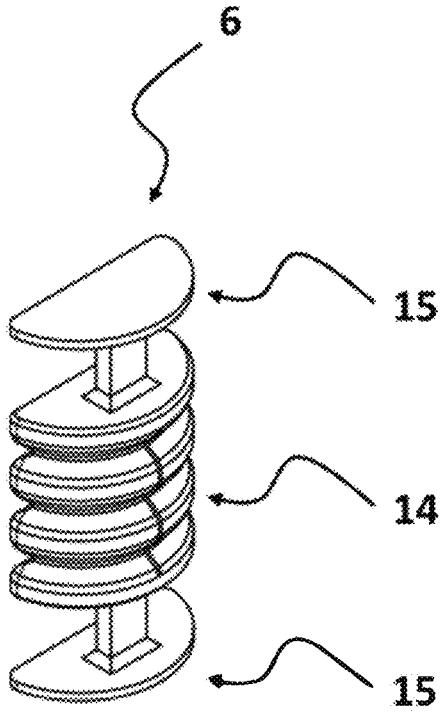

In the figures:

FIG. 1 schematically shows the structure of a hollow rod composite anchor according to the disclosure;

FIG. 2 schematically shows the structure of an anchor base with one or more outlet channels that can be used in the hollow rod composite anchor according to the disclosure;

FIG. 3 schematically shows a static mixing device which can be used in the hollow rod composite anchor according to the disclosure and comprises a plurality of mixing elements disposed one behind the other in a three-mixing row combination;

FIG. 4 schematically shows a static mixing device which can be used in the hollow rod composite anchor according to the disclosure and comprises a plurality of mixing elements disposed one behind the other in a two-mixing row combination;

FIG. 5 shows a possible design of the mixing device which can be used in the hollow rod composite anchor according to the disclosure; and FIG. 6 shows schematically the design of a squeezing plunger which can be used in the hollow rod composite anchor according to the disclosure;

Corresponding reference numerals indicate corresponding parts throughout the several views of the drawings.

DETAILED DESCRIPTION

Example embodiments will now be described more fully with reference to the accompanying drawings.

FIG. 1 shows a possible embodiment of a hollow rod composite anchor 1 according to the disclosure. Starting from the deepest point of the borehole, the hollow rod composite anchor 1 comprises an anchor base 3 which comprises one or more outlet channels (not shown) for the exit of a fastening agent from the hollow rod composite anchor 1. Via the outlet channels of the anchor base 3, fastening agent is pressed between the hollow rod composite anchor 2 and the borehole and the hollow rod composite anchor 1 is thus anchored in the borehole. At the anchor base 3 the hollow rod 2 is arranged, which extends over the other functional parts (4, 5, 6) of the hollow rod composite anchor 1 disposed in the interior. Inside the hollow rod 2, adjacent to the anchor base 2, the static mixing device 4 is disposed, in which the fastening agent, for example a two-component adhesive, is mixed before exiting through the anchor base 3. The adhesive is contained in a cartridge 5 divided into two compartments by a partition wall 20, which cartridge is squeezed by a squeezing plunger 6 by pressurization. In the application, the hollow rod composite anchor 1 is inserted into the borehole and the squeezing plunger 6 is moved, for example via water pressure, in the hollow rod 2 from the point farthest from the borehole in the direction of the anchor base 3. Due to the forces exerted the adhesive is pressed out of the cartridge 5 into the static mixing device 4. Within the mixing device 4, the adhesive is intimately mixed and enters the borehole via the outlet channels of the anchor base 3 and anchors the hollow rod composite anchor 1 in the borehole via the outer anchor walls. Hollow rod 2 comprises, at a point furthest from the anchor base 3, a fastening means 7 for a mounting a further hollow rod (not shown).

FIG. 2 shows a possible embodiment of an anchor base 3. The anchor base 3 can comprise an anchor tip in which one or more outlet channels 8 for the fastening agent are arranged.

FIG. 3 shows a side view of an arrangement according to the disclosure of mixing elements 16 of the static mixing device 4 disposed one behind the other. In this embodiment, the individual mixing elements 16 are combined to form three mixing element rows 9, wherein the row centers form a triangle relative to the direction of the force flux. This means that the mixing element rows 9 with the respective mixing elements 16 connected in series are arranged offset to each other, wherein two different geometries for the individual mixing elements 16 are shown in this representation. The flow of the fastening agent around the mixing elements 16 and rows 9 causes the direction of flow of the fastening agent to be deflected twice by approximately 180° between entry into and exit from the static mixer. The individual mixing element rows 9 and thus also the mixing elements 16 can be arranged offset from each other from the point of view of the force effect, so that different starting points of the mixing element rows 9 are obtained in the direction of the force effect.

FIG. 4 shows a side view of an arrangement of mixing elements 16 of the static mixing device 4 according to the disclosure arranged one behind the other. In this configuration, the individual mixing elements 16 are combined to form two mixing element rows 9 and the rear row of mixing elements in FIG. 3 has been omitted for the sake of clarity. The individual mixing element rows 9 are each composed of two different mixing elements 10, 11. These two configurations 10, 11 of the mixing elements 16 can contribute to an optimized mixing result without large increase in flow resistance. Relatively large quantities of high-viscosity fastening agent can also be processed with good mixing performance and a squeezing pressure that is not too high.

FIG. 5 shows a possible enclosure of the mixing device 4 within the hollow rod 2 (not shown). The mixing elements, which may be arranged to form mixing rows, can be easily and securely inserted into the hollow rod and anchored therein by means of this enclosure. An outlet opening 12 of the mixing device points in the direction of the anchor base 3 and the rear 13 of the mixing device 4 points in the direction of the cartridge divided into two compartments (not shown).

FIG. 6 shows a possible embodiment according to the disclosure of one half of a two-part squeezing plunger 6 according to the disclosure. The second half, not shown in FIG. 6 but depicted in FIG. 1, is mirror-symmetrical to the first half 6 and is fixed to the first half by means of a cutting device 21, shown in FIG. 1, which is arranged between the two halves 6. In FIG. 6, the upper and lower guide lips 15 and the central sealing lips 14 of the two-part squeezing plunger are shown. By means of this embodiment, even highly viscous fastening agents can be safely squeezed out by the static mixing device. In particular, the risk is reduced that fastening agent is pressed past the squeezing plunger in the direction of the borehole mouth and thus can no longer contribute to the fixing of the anchor in the borehole. In particular, the guide lips can contribute to a smoother movement of the squeezing plunger, wherein tilting is prevented even at high squeezing pressures or during rapid setting processes.

The foregoing description of the embodiments has been provided for purposes of illustration and description. It is not intended to be exhaustive or to limit the disclosure. Individual elements or features of a particular embodiment are generally not limited to that particular embodiment, but, where applicable, are inter-changeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. A hollow rod composite anchor for stabilizing rock strata in mining, tunnel construction, civil engineering and rock construction, at least comprising an anchor base comprising one or more outlet channels; and a hollow rod which can be fastened to the anchor base and comprises a static mixing device adjoining the anchor base, a cartridge which is divided into two compartments by a partition wall and is intended to receive chemical fastening agents, and a two-part squeezing plunger corresponding to the compartment division, wherein the static mixing device comprises a first end, an opposite second end, and a plurality of mixing elements arranged one behind the other, wherein, within the static mixing device, the chemical fastening agents flow first in a first direction from the first end toward the second end, subsequently in a second direction toward the first end, and further subsequently in the first direction toward the second end as the chemical fastening agents pass through the static mixing device.

2. The hollow rod composite anchor according to claim 1, wherein the cartridge is cylindrically shaped and comprises on the anchor base side an outlet opening to at least one of the outlet channels of the anchor base, wherein the outlet opening of the cartridge is arranged eccentrically to an axis of symmetry of the cylindrical cartridge.

3. The hollow rod composite anchor according to claim 1, wherein the mixing elements of the static mixing device are present in at least three different mixing element rows, wherein the individual mixing element rows are arranged offset from one another.

4. The hollow rod composite anchor according to claim 3, wherein the different mixing element rows are arranged offset relative to the anchor base along a longitudinal axis of the hollow rod composite anchor.

5. The hollow rod composite anchor according to claim 1, wherein the static mixing device consists of individual mixing elements, wherein the mixing elements have at least two different geometries.

6. The hollow rod composite anchor according to claim 1, wherein the squeezing plunger includes spaced-apart upper and lower guide lips and central sealing lips positioned therebetween.

7. The hollow rod composite anchor according to claim 1, wherein the two parts of the two-part squeezing plunger are rigidly connected to one another at least via a partition wall cutting device.

8. The hollow rod composite anchor according to claim 7, wherein the two parts of the two-part squeezing plunger are of mirror-symmetrical design and the partition wall cutting device is arranged eccentrically from a common axis of symmetry of the two parts of the two-part squeezing plungers.

9. A method of setting a hollow rod composite anchor in a rock stratum, wherein the method comprises at least the steps of:

a) drilling a hole in a rock stratum to be stabilized;

b) setting a hollow rod composite anchor according to claim 1; and c) squeezing the chemical fastening agent from the two compartments through the static mixer and the anchor base by pressurization.

10. The method according to claim 9, wherein in method step c) the pressure load over time per squeezing process is recorded and stored digitally.

* * * * *